US011473827B2

(12) United States Patent
Aaron et al.

(10) Patent No.: US 11,473,827 B2
(45) Date of Patent: Oct. 18, 2022

(54) ACTIVELY COOLED DEVICE FOR SMALL SCALE DELIVERY

(71) Applicant: CARRIER CORPORATION, Palm Beach Gardens, FL (US)

(72) Inventors: Kyle Aaron, Torrington, CT (US); Ciara Poolman, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 188 days.

(21) Appl. No.: 16/697,334

(22) PCT Filed: May 30, 2018

(86) PCT No.: PCT/US2018/035014
§ 371 (c)(1),
(2) Date: Nov. 27, 2019

(87) PCT Pub. No.: WO2018/222645
PCT Pub. Date: Dec. 6, 2018

(65) Prior Publication Data

US 2020/0116413 A1 Apr. 16, 2020

Related U.S. Application Data

(60) Provisional application No. 62/584,349, filed on Nov. 10, 2017, provisional application No. 62/513,178, filed on May 31, 2017.

(51) Int. Cl.
*F25D 11/00* (2006.01)
*B65D 81/18* (2006.01)
(Continued)

(52) U.S. Cl.
CPC ..... *F25D 11/003* (2013.01); *B65D 81/18* (2013.01); *F25B 21/02* (2013.01); *F25D 17/06* (2013.01);
(Continued)

(58) Field of Classification Search
CPC ..... F25D 11/003; F25D 29/003; F25D 17/06; F25D 2331/804; F25D 2400/12; F25D 2400/36; F25D 2700/12
See application file for complete search history.

(56) References Cited

U.S. PATENT DOCUMENTS 4,107,934 A 8/1978 Beitner
4,195,757 A * 4/1980 Jefferson ..... F25D 3/06 224/414
(Continued)

FOREIGN PATENT DOCUMENTS

CN 1786630 A 6/2006
CN 1867803 A 11/2006
(Continued)

OTHER PUBLICATIONS

Translation DE-102016225358-A1.*
(Continued)

*Primary Examiner* — Elizabeth J Martin
(74) *Attorney, Agent, or Firm* — Cantor Colburn LLP

(57) ABSTRACT

An environmental control unit for use with a transport container is provided. The environmental control unit includes: a thermoelectric device; a fan to blow air across the thermoelectric device; a cooling passage configured to receive the air blown across the thermoelectric device and convey the air to a compartment of a transport container when the transport container is removably connected to the environmental control unit; a controller in electronic communication with the thermoelectric device and the fan; a battery configured to power the environmental control unit; and one or more piezoelectric devices configured to generate electrical power to charge the battery, wherein each of the one or more piezoelectric devices is electrically connected to the battery.

15 Claims, 3 Drawing Sheets

(51) Int. Cl.

| | |
|---|---|
| ***F25B 21/02*** | (2006.01) |
| ***F25D 17/06*** | (2006.01) |
| ***F25D 19/02*** | (2006.01) |
| ***F25D 29/00*** | (2006.01) |

(52) U.S. Cl.

CPC ..... *F25D 19/02* (2013.01); *F25D 29/003* (2013.01); *F25D 2331/804* (2013.01); *F25D 2400/12* (2013.01); *F25D 2400/36* (2013.01); *F25D 2700/12* (2013.01)

(56) References Cited

U.S. PATENT DOCUMENTS

| | | | | |
|---|---|---|---|---|
| 4,301,658 | A | 11/1981 | Reed | |
| 4,346,562 | A | 8/1982 | Beitner | |
| 4,759,190 | A | 7/1988 | Trachtenberg et al. | |
| 5,029,446 | A | 7/1991 | Suzuki | |
| 5,081,977 | A | 1/1992 | Swenson | |
| 5,285,657 | A | 2/1994 | Bacchi et al. | |
| 5,549,096 | A | 8/1996 | Swenson et al. | |
| 6,260,360 | B1 | 7/2001 | Wheeler | |
| 6,276,470 | B1 | 8/2001 | Simeray et al. | |
| 6,321,550 | B1 * | 11/2001 | Chopko | F25B 27/00 62/196.2 |
| 6,344,630 | B1 | 2/2002 | Jarvis et al. | |
| 6,354,104 | B1 * | 3/2002 | Feagin | A61B 10/0096 220/210 |
| 6,666,032 | B1 | 12/2003 | Rickson et al. | |
| 6,732,534 | B2 | 5/2004 | Spry | |
| 7,082,773 | B2 | 8/2006 | Cauchy | |
| 7,198,512 | B1 | 4/2007 | Swiatek | |
| 7,278,270 | B2 | 10/2007 | Culp et al. | |
| 7,481,065 | B2 | 1/2009 | Krieger | |
| 7,827,806 | B2 | 11/2010 | Tuszkiewicz et al. | |
| 7,937,954 | B2 | 5/2011 | Kang et al. | |
| 8,353,167 | B2 | 1/2013 | McGann | |
| 8,468,836 | B2 | 6/2013 | Tuszkiewicz et al. | |
| 8,490,413 | B2 | 7/2013 | Blackway et al. | |
| 8,516,832 | B2 | 8/2013 | Bhavsar et al. | |
| 8,677,767 | B2 | 3/2014 | Ilercil et al. | |
| 8,839,631 | B2 | 9/2014 | Lu | |
| 9,995,529 | B1 | 6/2018 | Banks | |
| 2005/0091988 | A1 | 5/2005 | Stewart et al. | |
| 2007/0289325 | A1 | 12/2007 | Stone | |
| 2008/0262646 | A1 * | 10/2008 | Breed | G07C 5/0808 700/226 |
| 2009/0058352 | A1 | 3/2009 | Lin | |
| 2009/0158770 | A1 | 6/2009 | Cohrs et al. | |
| 2010/0146991 | A1 * | 6/2010 | Ilercil | B65D 81/18 62/3.3 |
| 2010/0264048 | A1 * | 10/2010 | Gunsberg | A45C 15/00 206/314 |
| 2012/0036869 | A1 | 2/2012 | Kim et al. | |
| 2012/0186272 | A1 | 7/2012 | Son | |
| 2013/0082044 | A1 | 4/2013 | Doan | |
| 2014/0085672 | A1 | 3/2014 | Takaishi | |
| 2014/0150464 | A1 | 6/2014 | Bloedow et al. | |
| 2014/0157794 | A1 * | 6/2014 | McGann | F25B 21/04 62/3.2 |
| 2015/0143823 | A1 | 5/2015 | Slack et al. | |
| 2015/0215684 | A1 * | 7/2015 | Kauffman | G06K 19/0723 340/870.16 |
| 2015/0241109 | A1 * | 8/2015 | Passley | F25D 11/003 62/426 |
| 2016/0003505 | A1 | 1/2016 | Trotter | |
| 2016/0243000 | A1 | 8/2016 | Gray | |
| 2016/0326765 | A1 | 11/2016 | Barbret | |
| 2017/0056289 | A1 * | 3/2017 | Tsuno | F25B 21/04 |
| 2017/0082344 | A1 | 3/2017 | Tansley | |
| 2017/0089619 | A1 | 3/2017 | Bing et al. | |
| 2017/0108253 | A1 * | 4/2017 | Monroy | A01N 1/0252 |

FOREIGN PATENT DOCUMENTS

| | | | |
|---|---|---|---|
| CN | 202098308 | U | 1/2012 |
| CN | 103532427 | A | 1/2014 |
| CN | 103673379 | A | 3/2014 |
| CN | 203810824 | U | 9/2014 |
| CN | 105627662 | A | 6/2016 |
| CN | 205536883 | U | 8/2016 |
| CN | 205619648 | U | 10/2016 |
| CN | 205747636 | U | 11/2016 |
| DE | 29506347 | U1 | 6/1995 |
| DE | 102016225358 | A1 * | 6/2018 |
| EP | 0346560 | A1 | 12/1989 |
| EP | 1152199 | B1 | 7/2005 |
| EP | 2390601 | A1 | 11/2011 |
| GB | 2331838 | A | 6/1999 |
| IN | 3329MUM2014 | A | 6/2015 |
| JP | 2012172906 | A | 9/2012 |
| KR | 20110028037 | A | 3/2011 |
| KR | 20120128037 | A | 11/2012 |
| KR | 101355646 | B1 | 1/2014 |
| TW | M507461 | U | 8/2015 |
| WO | 2008074011 | A2 | 6/2008 |
| WO | 2010121653 | A1 | 10/2010 |
| WO | 2013134355 | A1 | 9/2013 |
| WO | 2016181223 | A3 | 11/2016 |

OTHER PUBLICATIONS

Notification of Transmittal of the International Search Report for International Application No. PCT/US2018/035014; Report dated Aug. 10, 2018; 6 pages.

Written Opinion of the International Searching Authority for Application No. PCT/US2018/035014; Report dated Aug. 10, 2018; 9 pages.

First Chinese Office Action for Application No. 201880036529.5; Office Action dated Mar. 3, 2021; 9 pages.

* cited by examiner

ACTIVELY COOLED DEVICE FOR SMALL SCALE DELIVERY

BACKGROUND

The subject matter disclosed herein generally relates to the field of transport containers, and more particularly to an apparatus and method for cooling transport containers.

Refrigerated trucks and trailers are commonly used to transport perishable cargo, such as, for example, produce, meat, poultry, fish, dairy products, cut flowers, and other fresh or frozen perishable products. A transport refrigeration system is mounted to the truck or to the trailer in operative association with a cargo space defined within the truck or trailer for maintaining a controlled temperature environment within the cargo space.

Conventionally, transport refrigeration systems used in connection with refrigerated trucks and refrigerated trailers include a transport environmental control unit having a refrigerant compressor, a condenser with one or more associated condenser fans, an expansion device, and an evaporator with one or more associated evaporator fans, which are connected via appropriate refrigerant lines in a closed refrigerant flow circuit. Air or an air/gas mixture is drawn from the interior volume of the cargo space by means of the evaporator fan(s) associated with the evaporator, passed through the airside of the evaporator in heat exchange relationship with refrigerant whereby the refrigerant absorbs heat from the air, thereby cooling the air. The cooled air is then supplied back to the cargo space.

Currently last mile cooling is served by either dry ice or just insulated containers, there are few use cases where a smaller compressor driven system can be used due to size, weight, etc. Typically, the perishable cargo within the truck's transport refrigeration system is contained within simple cardboard boxes, wooden crates, or plastic containers and is cooled or heated by the truck's environmental control system. Upon arriving at a destination the perishable cargo is unloaded onto a dock or other uncontrolled area where it may sit for hours until it could be moved to an environmentally controlled location. The perishable cargo may also need to be transported for the "last mile" to the consumer via a non-refrigerated means, such as a motorcycle or truck. This time spent on dock or in "last mile" transit, out of a controlled environment, leads to the degradation of the product life and ultimately leads to a lower quality product being served to the end consumer.

BRIEF SUMMARY

According to one embodiment, an environmental control unit for use with a transport container is provided. The environmental control unit comprises: a thermoelectric device; a fan to blow air across the thermoelectric device; a cooling passageway configured to receive the air blown across the thermoelectric device and convey the air to a compartment of a transport container when the transport container is removably connected to the environmental control unit; a controller in electronic communication with the thermoelectric device and the fan; and a communication module in electronic communication with the controller, wherein the communication module is configured to transmit parameters of the environmental control unit to a computing device through wireless communication.

In addition to one or more of the features described above, or as an alternative, further embodiments may include a battery configured to power the environmental control unit.

In addition to one or more of the features described above, or as an alternative, further embodiments may include a power source configured to power the environmental control unit, wherein the power source is a flywheel generator.

In addition to one or more of the features described above, or as an alternative, further embodiments may include a power source configured to power the environmental control unit, wherein the power source is a vehicle battery.

In addition to one or more of the features described above, or as an alternative, further embodiments may include that the communication module is configured to receive control commands from the computing device; and the controller is configured to adjust operation of the fan and the thermoelectric device in response to the control command.

In addition to one or more of the features described above, or as an alternative, further embodiments may include one or more sensors, configured to detect at least one of a temperature of air flowing through the cooling passageway, humidity of air flowing through the cooling passageway, and a location of the environmental control unit.

In addition to one or more of the features described above, or as an alternative, further embodiments may include that the transport container includes more than one compartment; and the environmental control unit includes at least one thermoelectric device for each compartment.

In addition to one or more of the features described above, or as an alternative, further embodiments may include a control panel located on the exterior of the environmental control unit, wherein the control panel is configured to receive input of at least one of a selected temperature for the environmental control unit, a maximum temperature for the environmental control unit, and a minimum temperature for the environmental control unit.

In addition to one or more of the features described above, or as an alternative, further embodiments may include one or more piezoelectric devices configured to generate electrical power to charge the battery, wherein each of the one or more piezoelectric devices is electrically connected to the battery.

In addition to one or more of the features described above, or as an alternative, further embodiments may include that each of the one or more piezoelectric devices is operably connected to the transport container such that vibrations of the transport container are transferred to the one or more piezoelectric devices.

In addition to one or more of the features described above, or as an alternative, further embodiments may include that each of the one or more piezoelectric devices may be located within the transport container and operably connected to the compartment such that a weight of the compartment is transferred to each of the one or more piezoelectric devices.

In addition to one or more of the features described above, or as an alternative, further embodiments may include that each of the one or more piezoelectric devices may be located in a separate attachment assembly that operably connects to a bottom of the transport container, such that a weight of the transport container is transferred to each of the one or more piezoelectric devices.

According to another embodiment, a refrigerated transport system is provided. The refrigerated transport system comprises: a transport container; an environmental control unit removably connected to the transport container, the environmental control unit comprising: a thermoelectric device; a fan to blow air across the thermoelectric device; a cooling passageway configured to receive the air blown across the thermoelectric device and convey the air to a compartment of the transport container; a controller in electronic communication with the thermoelectric device and the fan; and a communication module in electronic communication with the controller and wireless communication with a computing device, wherein the communication module is configured to transmit parameters of the environmental control unit to the computing device through wireless communication.

In addition to one or more of the features described above, or as an alternative, further embodiments may include a battery configured to power the environmental control unit.

In addition to one or more of the features described above, or as an alternative, further embodiments may include a power source configured to power the environmental control unit, wherein the power source is a flywheel generator.

In addition to one or more of the features described above, or as an alternative, further embodiments may include a power source configured to power the environmental control unit, wherein the power source is a vehicle battery.

In addition to one or more of the features described above, or as an alternative, further embodiments may include that the communication module is configured to receive control commands from the computing device; and the controller is configured to adjust operation of the fan and the thermoelectric device in response to the control command.

In addition to one or more of the features described above, or as an alternative, further embodiments may include one or more sensors, configured to detect at least one of a temperature of air flowing through the cooling passageway, humidity of air flowing through the cooling passageway, and a location of the environmental control unit.

In addition to one or more of the features described above, or as an alternative, further embodiments may include that the transport container includes more than one compartment; and the environmental control unit includes at least one thermoelectric device for each compartment.

In addition to one or more of the features described above, or as an alternative, further embodiments may include a control panel located on the exterior of the environmental control unit, wherein the control panel is configured to receive input of at least one of a selected temperature for the environmental control unit, a maximum temperature for the environmental control unit, and a minimum temperature for the environmental control unit.

In addition to one or more of the features described above, or as an alternative, further embodiments may include that the computing device is configured to display parameters on a map though a graphical user interface.

In addition to one or more of the features described above, or as an alternative, further embodiments may include one or more piezoelectric devices configured to generate electrical power to charge the battery, wherein each of the one or more piezoelectric devices is electrically connected to the battery.

In addition to one or more of the features described above, or as an alternative, further embodiments may include that each of the one or more piezoelectric devices is operably connected to the transport container such that vibrations of the transport container are transferred to the one or more piezoelectric devices.

In addition to one or more of the features described above, or as an alternative, further embodiments may include that each of the one or more piezoelectric devices may be located within the transport container and operably connected to the compartment such that a weight of the compartment is transferred to each of the one or more piezoelectric devices.

In addition to one or more of the features described above, or as an alternative, further embodiments may include that each of the one or more piezoelectric devices may be located in a separate attachment assembly that operably connects to a bottom of the transport container, such that a weight of the transport container is transferred to each of the one or more piezoelectric devices.

According to another embodiment, a method of managing environmental conditions within a refrigerated transport system through a computing device is provided, the method comprising: removably connecting an environmental control unit to a transport container; launching an application on a computing device; scanning for environmental control systems located within a selected radius of the computing device; displaying the environmental control systems located within the selected radius through a graphical user interface on the mobile device; connecting the computing device to a specific environmental control system; and displaying parameters of the specific environmental control unit when the computing device is connected to the specific environmental control system.

In addition to one or more of the features described above, or as an alternative, further embodiments may include adjusting operation of the specific environmental control system using the computing device.

In addition to one or more of the features described above, or as an alternative, further embodiments may include: generating map through the graphical user interphase on the computing device; and displaying the parameters on the map.

Technical effects of embodiments of the present disclosure include cooling a transport container using removably connected environmental control unit capable of being wirelessly controlled through a computing device.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Various embodiments of the present disclosure are related to environmental control of perishable cargo during the "last mile" of delivery. Typically, the perishable cargo in a truck's transport environmental control system is contained within simple cardboard boxes, wooden crates, or plastic containers. The perishable cargo may need to be transported on smaller-vehicles without environmental control systems over the "last-mile" to make it to market. The term "last mile" is figurative to illustrate the final stretch of a supply chain that perishable goods may take to arrive at a market. Often large trucks with environmental control systems cannot carry the perishable goods through this "last mile" due to multiple reasons, such as, for example, the size of city streets. For these reasons, smaller vehicles must carry the perishable goods over the "last mile", such as for example, motorcycles, mopeds, bicycles, and rickshaws. This time spent on smaller vehicles, out of a controlled environment leads to degradation of the product life and ultimately leads to a lower quality product being available to the end consumer. For instance, the life of a fragile ripe at harvest fruit such as, for example, raspberries and blueberries, decreases with the amount of time they spend in ambient air. Advantageously, the embodiments disclosed herein help preserve perishable goods through the "last mile" of the supply chain.

Figure 1:
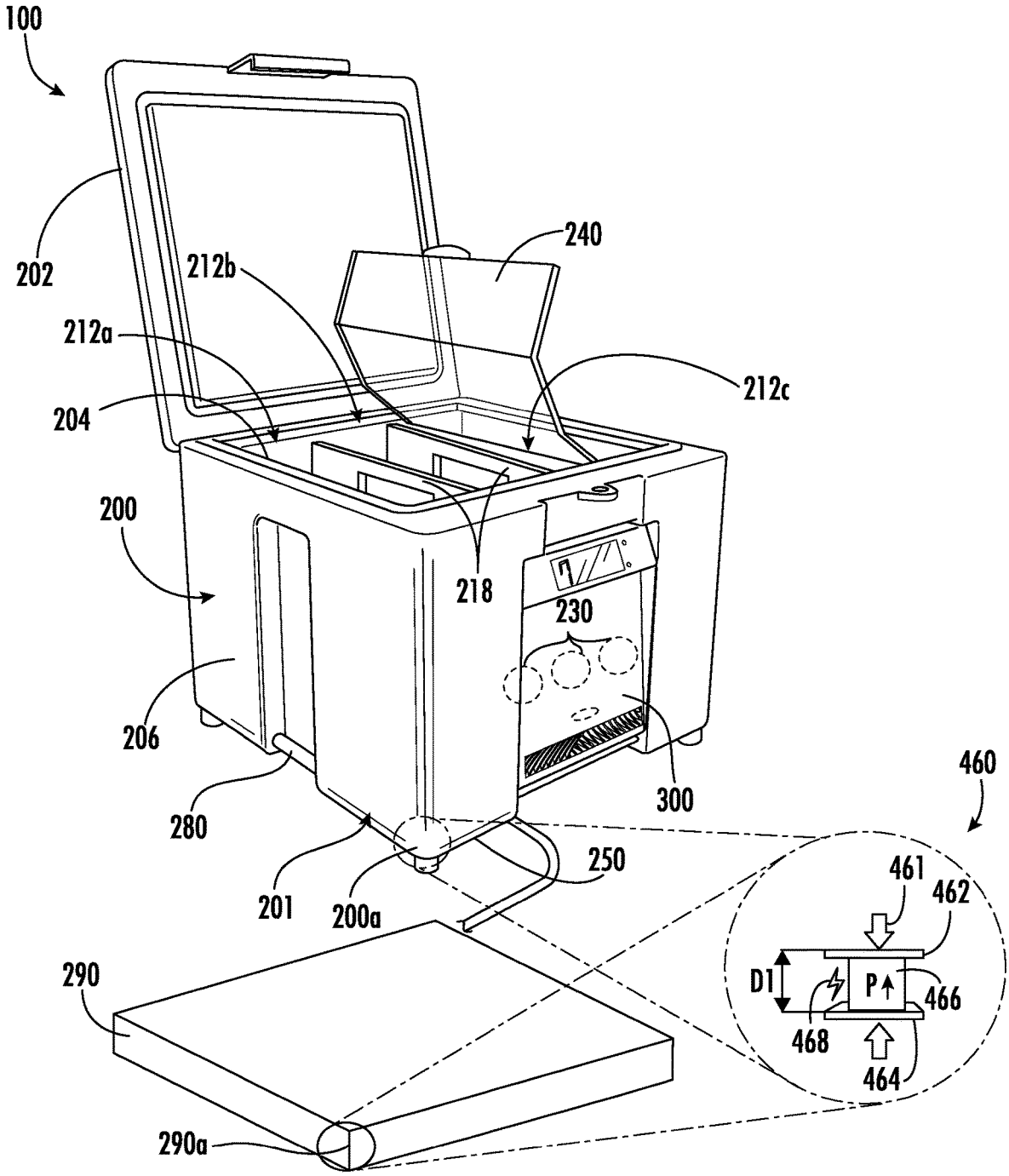
FIG. 1 illustrates a isometric view of a refrigerated transport system, in accordance with an embodiment of the disclosure.

Referring to FIG. 1, which depicts an isometric view of a refrigerated transport system 100 in an example embodiment. The refrigerated transport system 100 includes a transport container 200 and an environmental unit 300 removably connected to the transport container 200. The environmental unit 300 is removable from the transport container 200 and may be connected to a variety of different transport containers other than what is depicted in the illustrated embodiment of FIG. 1. The environmental unit 300 provides cooling to the transport container through one or more cooling passageways 362 and will be discussed further below. In order to removably connect the environmental control unit 300 to the transport container 200, one or more orifices 230 are formed in the base 206 of the transport container 200 and then cooling passageways 362 inserted into each orifice 230. There may be one cooling passageway 230 for each compartment 212 of the transport container 200, thus there may be one orifice 230 for each compartment 212. The cooling passageways 362 may include seals (not shown) configured to seal the connection between each formed orifices 230 and each cooling passageways 362.

The transport container 200 may be composed of a base 201 and a lid 202. As shown in FIG. 1, base 201 may be an open ended container wherein perishable cargo, such as, for example, produce, meat, poultry, fish, dairy products, cut flowers, pharmaceuticals, organs, and other fresh/frozen perishable products, is stowed for transport. The lid 202 is configured to fit on the base 201, thus enclosing the perishable cargo within the transport container 200. The lid 202 is configured to securely fasten to the base 201 such that an airtight seal is created between the lid 202 and the base 201. In various embodiments, the base 201 and the lid 202 may be composed of a plastic, metal vacuum, extruded polystyrene foam, polyurethane foam, polyethylene foam, or other lightweight insulating material. In one embodiment, the base 201 is collapsible and may be folded when not in use for easy storage and transportation.

The base 201 further includes an interior 204 and an exterior 206. The interior 204 houses the perishable goods and may be subdivided into multiple compartments 212*a*-212*c* by dividers 218. A secondary lid 240 may provide additional insulation to each compartments 212*a*-212*c* and/or the interior 204 in general. The secondary lid 240 also keeps additional cold air from escaping, thus increasing efficiency. In an embodiment, the secondary lid 240 may be transparent, which advantageously provides the opportunity to still see goods in each compartment 212*a*-212*c*. Anchors 280 may be located on the exterior 206 of the base 201 so that the refrigerated transport system 100 may be secured to a vehicle, such as, for example a motorcycle.

The transport container 200 may further include one or more piezoelectric devices 460 configured to generate electrical power 468 when a force 461 is applied to the piezoelectric device 460. The force 461 may be vibrations (i.e. vibratory forces) of the transport container 200 itself and/or vibrations (i.e. vibratory forces) of the cargo inside one or more compartments 212*a*-212*c*. Each of the one or more piezoelectric devices 460 may be electrically connected to the battery 320 (see FIG. 2), such that when electrical power 468 is generated by each piezoelectric device 460 the battery 320 is charged. Each of the one or more piezoelectric devices 460 is operably connected to the transport container 200 such that vibrations of the transport container 200 are transferred to the one or more piezoelectric device 460.

In a first non-limiting example, the one or more piezoelectric devices 460 may each be located within the transport container 200 and operably connected to one or more compartments 212*a*-212*c* such that the weight of each compartment 212*a*-212*c* is transferred to each of the one or more piezoelectric devices 460. Advantageously, in this first non-limiting example, as the goods in each compartment 212*a*-212*c* are being transported, for example on the back of a motorcycle, the goods may bounce/vibrate in each compartment 212*a*-212*c* and thus the compartments 212*a*-212*c* would transfer forces 461 from the bouncing and vibrating goods to each piezoelectric device 460 in order to generate electrical power 468. In a non-limiting embodiment, there may be a piezoelectric device 460 located within the transport container 200 at each of the four corners 200*a* of the transport container 200.

In a second non-limiting example, the one or more piezoelectric devices 460 may each be located in a separate attachment assembly 290 that operably connects to a bottom 250 of the transport container 200, such that the weight of the transport container 200 is transferred to each piezoelectric device 460. Advantageously, in this second non-limiting example, as the goods in the transport container 200 are being transported, for example on the back of a motorcycle, the goods may bounce/vibrate in the transport container 200 and thus the bottom 250 of the transport container would transfer forces 461 from the bouncing and vibrating goods to each piezoelectric device 460 in order to generate electrical power 468. In anon-limiting embodiment, there may be a piezoelectric device 460 located at each of the four corners 290*a* of attachment assembly 290.

Figure 2:
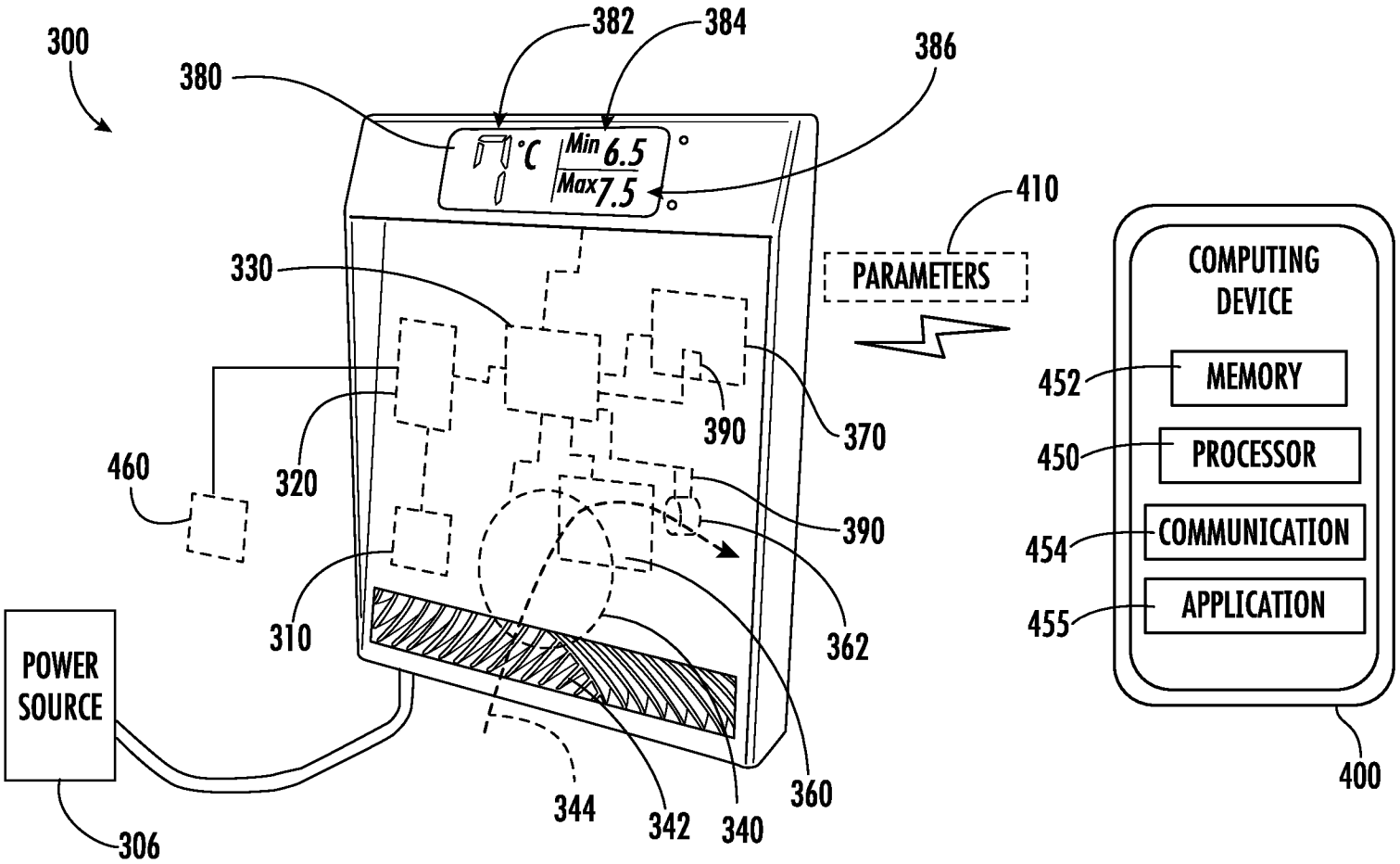
FIG. 2 illustrates an isometric view of an environmental control unit, in accordance with an embodiment of the disclosure.

It is understood that the piezoelectric devices 460 may be composed of different materials and configurations, thus the disclosure herein is not limited to the piezoelectric device 200 as illustrated in FIG. 1. As shown in FIG. 1, the piezoelectric device 200 may be composed of a piezoelectric material 466 interposed between a first plate 462 and a second plate 464. The first plate 462 and second plate 464 may be separate by a distance D1. As the force 461 is applied to the piezoelectric device 460, the piezoelectric material 466 may expand and contract thus changing the distance D1 between the first plate 462 and the second plate 464. The expansion and contraction of the piezoelectric material 466 generates the electrical power 468, which is transferred to the plates 462, 464 and the battery 320 (see FIG. 2). Referring now to FIG. 2 with continued reference to FIG. 1. FIG. 2 illustrates an isometric view of the environmental control unit 300. The environmental control unit 300 may include a power convertor 310, a battery 320, a controller 330, a fan 340, a thermoelectric device 360, a communication module 370, and a control panel 380. The thermoelectric device 360 provides cooling to the transport container 200. The thermoelectric device 360 in operation generates heating/cooling by creating a temperature difference across two sides of the thermoelectric device 360 when a voltage is applied to the thermoelectric device 360. The amount of heating and cooling changes in response to polarity of the voltage that is applied to the thermoelectric device 360 as the material properties cause the atoms to diffuse to a first side or a second side of the thermoelectric device 360. This is also known as Peltier effect. In an embodiment, there is a thermoelectric device 360 for each compartment 212. There may be a single fan 340 or a fan 340 for each thermos electric device 360. The fan 340 pulls in air 344 external to environmental control unit 300 through a vent 342. The air 344 that passes across the thermoelectric device 360 is cooled and is then sent through the cooling passageways 362 into the transport container 200. It is to be understood that the term "air" when used herein with reference to the atmosphere draw into the environmental control unit 300 by the fan 340 may include a mixture of oxygen with other gases, such as for example, but not limited to, nitrogen or carbon dioxide. The fan 340 may be rotated by a fan motor (not shown) powered by the power source 306 and/or the battery 320.

The environmental control unit 300 also includes a controller 330 configured for controlling the operation of the environmental control unit 300 including, but not limited to, the operation of thermoelectric device 360 and fan 340 to provide and maintain a desired thermal environment within the transport container 200. The controller 330 may be an electronic controller including a processor and an associated memory comprising computer-executable instructions that, when executed by the processor, cause the processor to perform various operations. The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be a storage device such as, for example, a random access memory (RAM), read only memory (ROM), or other electronic, optical, magnetic or any other computer readable medium. The operation of the environmental control unit 300 may also be controlled through the control panel 380 located on the exterior of the environmental control unit 300. Using the control panel 380, users may set a selected temperature 382 for each compartment 212 of the refrigerated transport system 100. Also using the control panel 380, users may set a maximum temperature 386 and a minimum temperature 384 for the selected temperature 382.

The controller 330 is in electronic communication with the communication module 370. The communication module 370 may be in wireless communication with a computing device 400, such as, for example a smart phone, PDA, smart watch, tablet, laptop computer, desktop computer etc. The computing device 400 may include a touch screen (not shown), mouse, keyboard, scroll wheel, physical button, or any input mechanism known to one of skill in the art. The computing device 400 may include a processor 450, memory 452 and communication module 454 as shown in FIG. 1. The processor 450 can be any type or combination of computer processors, such as a microprocessor, microcontroller, digital signal processor, application specific integrated circuit, programmable logic device, and/or field programmable gate array. The memory 452 is an example of anon-transitory computer readable storage medium tangibly embodied in the computing device 400 including executable instructions stored therein, for instance, as firmware. The communication module 454 may implement one or more communication protocols as described in further detail herein. Embodiments herein generate a graphical user interface on the computing device 400 through an application 455. The computing device 400 may view and/or adjust parameters 410 of the environmental control system through the application 455.

The wireless communication between the communication module 370 of the environmental control system 300 and the communication module 454 of the computing device 400 may be satellite, Wi-Fi, cellular, Bluetooth, radio communication or any other wireless communication method known to one of skill in the art. The computing device 400 may be configured to wirelessly control the operation of the environmental control unit 300 and/or display the parameters 410 of the environmental control unit 300. The parameters 410 may include but are not limited to location of the environmental control unit 300, temperature of the cooling output of the environmental control unit 300, and humidity of the cooling output of the environmental control unit 300. The location and temperature output may be detected but one or more sensors 390. In an embodiment, a sensor 390 may include a temperature sensor or humidity sensor. The temperature sensor or humidity sensor may be located proximate the one or more cooling passageways 362. In an embodiment, a sensor 390 may include a GPS sensor configured to determine the location of the environmental control unit 300.

The environmental control unit 300 may be powered by an external power source 306 and/or a battery 320. The power source 306 may charge the battery 320 such that the battery 320 may provide power to the environmental control unit 300 when the environmental control unit 300 is receiving reduced and/or no power from the power source 306. The power source 306 may comprise an AC generator configured to generate alternating current (AC) power including at least one AC voltage at one or more frequencies. In an embodiment, the power source 306 may, for example, be a permanent magnet AC generator or a synchronous AC generator. In another embodiment, the power source 306 may comprise a single on-board, DC generator configured to generate direct current (DC) power at at least one voltage. In an embodiment, the power source 306 is a fly wheel generator operably connected to a rotating component of a vehicle. In an embodiment, the power source 306 may be an onboard battery of a vehicle, such as, for example a 12V battery. Some power sources may have internal voltage regulators while other power sources do not. It is to be understood that various power converters 310, such as AC to DC rectifiers, DC to AC inverters, AC to AC voltage/frequency converters, and DC to DC voltage converters, may be employed in connection with the power source 306 as appropriate. The power converter 310 may include a voltage sensor to sense the voltage of the power source 306. The power source 306 may also include a battery, a solar panel, or any similar power source known to one of skill in the art. As described above, the power source 306 may include one or more piezoelectric devices 460 configured to generate electrical power 468 as described above. The one or more piezoelectric devices 460 may be connected to the battery 320 and/or the power converter 310.

Figure 3:
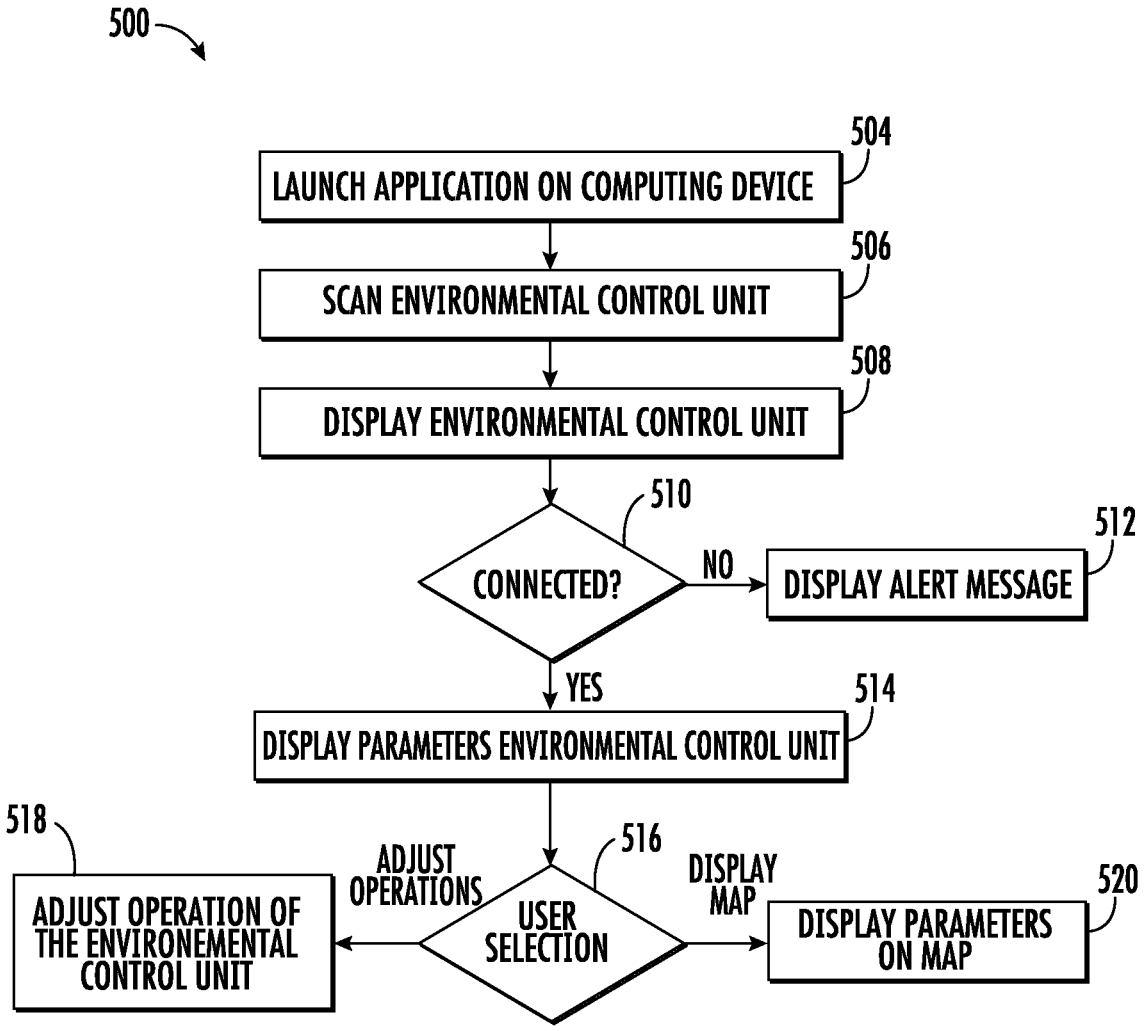
FIG. 3 is a flow diagram illustrating a managing environmental conditions within a refrigerated transport system, according to an embodiment of the present disclosure.

Referring now to FIG. 3, while referencing components of FIG. 1. FIG. 3 shows a flow diagram illustrating a method 500 of managing environmental conditions within a refrigerated transport system 100 through a computing device 400. The first step may be removably connecting an environmental control unit 300 to a transport container 200 if not already connected. In order to removably connect the environmental control unit 300 to the transport container 200, one or more orifices 230 may need to be formed in the base 206 of the transport container 200 and then a cooling passageway 362 slid into each of the formed orifices 230. As mentioned above, there may be one cooling passageway 230 for each compartment 212, thus there may be one orifice 230 for each compartment 212. The cooling passageways 362 may include seals (not shown) configured to seal the connection between each formed orifice 230 and each cooling passageway 362. At block 504, an application is launched in a graphical user interface of the computing device 400. At bock 506, the computing device 400 scans for environmental control systems 300 located within a selected radius of the computing device 400. At block 508, the computing device 400 displays through the graphical user interface the environmental control systems 300 located within a selected radius of the computing device 400. A user may selected a specific environmental control system 300 through the graphical user interface in order to connect with the specific environmental control system 300. At block 510, will confirm when the computing device 400 is connected to the specific environmental control system 300. If the computing device 400 does not connect to the specific environmental control system 300 then an alert message may display on the computing device 400 through the graphical user interface at block 512. The alert message may be visual and/or audible. If the computing device 400 does connect to the specific environmental control system 300 then parameters 410 of the specific environmental control system 300 will display on the computing device 400 through the graphical user interface.

At block 516, the user may make a selection through the graphical user interface whether to adjust the operations of the specific environmental control system 300 or display the parameters 410 of the specific environmental control system 300 on a map. If at block 516, the user selects to adjust the operations, then at block 518 the user may adjust the operations of the specific environmental control system 300 including but not limited to, temperature and humidity within the transport container 200. The controller 330 is configured to adjust operation of the fan 340 and the thermoelectric device 360 in response to a control command from a computing device 400 to adjust temperature and humidity. If at block 516, the user selects to view a map of the parameters 410, then at block 520 the graphical user interface with display a map of the parameters 410 of the environmental control system 300 on the computing device 400.

While the above description has described the flow process of FIG. 3 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A refrigerated transport system comprising:

a transport container comprising a base, a lid configured to fit on the base, and an anchor on the base, the anchor configured to secure the transport container to a vehicle, wherein the transport container is sized to fit on a motorcycle-;

an environmental control unit located in the base and removably connected to the base, the environmental control unit comprising:

a thermoelectric device;

a fan to blow air across the thermoelectric device;

a cooling passageway configured to receive the air blown across the thermoelectric device and convey the air to one or more compartments of the transport container;

a controller in electronic communication with the thermoelectric device and the fan;

a battery configured to power the environmental control unit; and a separate attachment assembly that operably connects to a bottom of the transport container, the separate attachment assembly including one or more piezoelectric devices configured to generate electrical power to charge the battery, wherein each of the one or more piezoelectric devices is electrically connected to the battery, each of the one or more piezoelectric devices having a longitudinal axis;

wherein the one or more piezoelectric devices are located proximate a bottom of the base such that vibrations of the transport container in a direction coaxial with the longitudinal axis of each piezoelectric device are transferred to each piezoelectric devices.

2. The refrigerated transport system of claim 1, further comprising:

a power source configured to power the environmental control unit, wherein the power source is a flywheel generator.

3. The refrigerated transport system of claim 1, further comprising:

a power source configured to power the environmental control unit, wherein the power source is a vehicle battery.

4. The refrigerated transport system of claim 1, further comprising:

one or more sensors, configured to detect at least one of a temperature of air flowing through the cooling passageway, humidity of air flowing through the cooling passageway, and a location of the environmental control unit.

5. The refrigerated transport system of claim 1, wherein:

the one or more compartments includes more than one compartment; and the environmental control unit includes at least one thermoelectric device for each of the one or more compartments.

6. The refrigerated transport system of claim 1, further comprising:

a control panel located on the exterior of the environmental control unit, wherein the control panel is configured to receive input of at least one of a selected temperature for the environmental control unit, a maximum temperature for the environmental control unit, and a minimum temperature for the environmental control unit.

7. The refrigerated transport system of claim 1, wherein:

the computing device is configured to display parameters on a map though a graphical user interface.

8. The refrigerated transport system of claim 1, wherein the base of the transport container includes for corners, and wherein there is one of the one or more piezoelectric devices located proximate or at each of the four corners.

9. The refrigerated transport system of claim 1, wherein the base is configured to be collapsible and folded.

10. The refrigerated transport system of claim 1, wherein the anchors are located proximate the bottom of the base.

11. The refrigerated transport system of claim 1, further comprising a secondary lid located between the lid and the one or more compartments.

12. The refrigerated transport system of claim 11, wherein the secondary lid is transparent.

13. A method of managing environmental conditions within a refrigerated transport system through a computing device, the method comprising:

removably connecting an environmental control unit to a transport container, the transport container comprising a base, a lid configured to fit on the base, and an anchor on a base, the anchor configured to secure the transport container to a vehicle, wherein the transport container is sized to fit on a motorcycle, the environmental control unit being located in the base;

launching an application on a computing device;

scanning for environmental control systems located within a selected radius of the computing device;

displaying the environmental control systems located within the selected radius through a graphical user interface on the mobile device;

connecting the computing device to a specific environmental control system;

displaying parameters of the specific environmental control unit when the computing device is connected to the specific environmental control system; and powering the environmental control unit using a battery; and generating electrical power to charge the battery using one or more piezoelectric devices, wherein each of the one or more piezoelectric devices is electrically connected to the battery and has a longitudinal axis, wherein the one or more piezoelectric devices are located in a separate attachment assembly that operably connects to a bottom of the transport container such that vibrations of the transport container in a direction coaxial with the longitudinal axis of the one or more piezoelectric devices are is transferred to each piezoelectric device.

14. The method of claim 13, further comprising:

adjusting operation of the specific environmental control system using the computing device.

15. The method of claim 13, further comprising:

generating map through the graphical user interphase on the computing device; and displaying the parameters on the map.

* * * * *